United States Patent [19]

Lacasa et al.

[11] Patent Number: 4,620,666

[45] Date of Patent: Nov. 4, 1986

[54] FOLDING SHIPPING CONTAINER

[76] Inventors: Jaime Lacasa; Judith N. Lacasa, both of 2617 Cleveland Dr., Ames, Iowa 50010

[21] Appl. No.: 795,336

[22] Filed: Nov. 6, 1985

[51] Int. Cl.[4] ..... B65D 5/22

[52] U.S. Cl. ..... 229/149; 229/45 R; 229/110; 229/151; 229/154

[58] Field of Search ..... 229/33, 34 R, 34 B, 229/34 HW, 44 R, 45 R

[56] References Cited

U.S. PATENT DOCUMENTS

| | | | |
|---|---|---|---|
| 1,149,891 | 8/1915 | Billstein | 229/34 R |
| 1,209,363 | 12/1916 | Schluembach | 229/34 R |
| 1,739,853 | 12/1929 | Nelson | 229/33 |
| 1,838,191 | 12/1931 | Rumpel | 229/33 |
| 1,965,951 | 7/1934 | Williams | 229/34 R |
| 2,358,943 | 9/1944 | Smith | 229/45 R |
| 2,608,340 | 8/1952 | Donnell | 229/33 |
| 2,858,058 | 10/1958 | Kitchell | 229/33 |
| 3,669,341 | 6/1972 | Hughes | 229/33 |
| 4,347,968 | 9/1982 | Cornell et al. | 229/33 |
| 4,362,266 | 12/1982 | Webinger | 229/33 |

FOREIGN PATENT DOCUMENTS

| | | | |
|---|---|---|---|
| 76284 | 8/1961 | France | 229/34 R |
| 290762 | 5/1953 | Switzerland | 229/34 R |
| 751638 | 7/1956 | United Kingdom | 229/45 R |

*Primary Examiner*—Stephen P. Garbe
*Assistant Examiner*—Gary E. Elkin
*Attorney, Agent, or Firm*—Zarley, McKee, Thomte, Voorhees & Sease

[57] ABSTRACT

The present invention comprises a polygonal folding shipping container, one embodiment of which is a rectangular box having a bottom wall, a top wall, a rear wall, a front wall and two opposite side walls. The front wall and the two opposite side walls each include inner and outer panels which are folded with respect to one another at the upper edge of the wall. A slot extends along the upper edge of each of the front and side walls. The rear wall extends upwardly and is connected to a top wall which has a plurality of flaps along its outer edges. Each of the flaps extend into the slots in the front and side walls.

3 Claims, 6 Drawing Figures

FOLDING SHIPPING CONTAINER

BACKGROUND OF THE INVENTION

This invention relates to a folding shipping container.

Shipping containers are often subjected to large forces and to rough handling, and therefore it is important that such containers be capable of withstanding the forces and pressures normally encountered during shipment. Many containers collapse in response to the rigors of handling and transportation.

Another important requirement for shipping containers is the ability of the container to provide the maximum strength with the minimum amount of weight. Preferably the container should be constructed of paperboard or some other light material.

Another problem encountered with shipping containers is the necessity of storing the containers when they are not being used. The preferred manner for doing this is to provide a foldable container which is flat during non-use, but which can be rapidly and easily folded into the desired shape for use.

A further problem encountered in shipping containers is the requirement that the shipping container be secure during shipment. Many containers fall apart or become opened during shipment.

A further problem encountered with shipping containers having double thickness folded side walls is that the inner panels of the side walls often protrude into the compartment, thereby hindering the contents of the container.

In order to secure folding containers tightly, flaps are usually used. However, these flaps often protrude within the interior of the compartment of the container, thereby engaging and interfering with the contents of the container.

Therefore, a primary object of the present invention is the provision of an improved folding and shipping container.

A further object of the present invention is the provision of a folding container which is light in weight and which is strong in construction.

A further object of the present invention is the provision of a folding container which is sufficiently strong to withstand forces encountered during shipping, handling and storing.

A further object of the present invention is the provision of a folding container which can be maintained in a flat state for storage, but which can be folded rapidly and easily to provide the desired shipping container.

A further object of the present invention is the provision of a container which includes a front and side walls of double folded over panel construction.

A further object of the present invention is the provision of a folding shipping container having a front wall which holds the doubled over side panels of the side walls in place so that they do not protrude inwardly into the container and interfere with the contents of the container.

A further object of the present invention is the provision of a folding container which permits the rear, front and side walls to be folded into place so that all four walls are secured prior to moving the lid into closing position.

A further object of the present invention is the provision of a device which includes flaps on the lid which are concealed when the container is closed, thus avoiding potential complications that could arise if any or all of the flaps were inside the cavity of the container, or exposed to the outside of the box.

A further object of the present invention is the provision of a folding container where both the interior and the exterior are smooth so that there are no protrusions for engaging the contents of the container.

A further object of the present invention is the provision of a folding container which has a lid which can be closed and locked in place without the contents of the container being touched by the flaps on the lid.

A further object of the present invention is the provision of a folding container which is economical in construction, durable in use and efficient in operation.

SUMMARY OF THE INVENTION

The present invention utilizes a folding container which is polygonal in shape. The preferred embodiment is a rectangular container which includes a top wall, a bottom wall, a rear wall, a front wall and two opposite side walls. The front wall and the two opposite side walls are each of double panel construction, including an outer panel and an inner panel which is connected to the upper edge of the outer panel and is folded inwardly. The juncture between the inner and outer panels includes an elongated slot which is presented upwardly.

The rear wall of the container is connected to the rear edge of the bottom wall and extends upwardly therefrom. The opposite ends of the rear wall of the container include flaps which extend into the space between the inner and outer panels of the side walls. Extending upwardly from the upper edge of the rear wall is a top wall having a plurality of flaps connected to its edges for extending downwardly into the slots formed in the two side walls and the front wall.

The front wall includes a pair of end flaps similar to the end flaps of the rear wall, and these end flaps extend into the space between the inner and outer panels of the side walls.

The container is integral in construction, and all of the walls and side flaps are formed from a single blank which can be cut with a die in the patterns shown in FIGS. 4 and 6 of the drawings.

The present folding container is designed for shipping and is capable of withstanding the rough treatment often encountered during shipping. The front wall is an important feature of the invention in that it includes an outer panel which is folded over to form a second inner panel. The inner panel engages the two inner panels of the side walls so as to prevent those inner panels from extending or flopping inwardly to interfere with the contents of the container. None of the folded over panels can spring in towards the center of the container.

Another important feature of the present invention is that it does not require added fasteners or slits in the base to hold protrusions from the fold-over panels in order to keep the two side panel fold-overs in place.

Another important feature of the present invention is the fact that the container can have all four walls secured in place before the lid is moved into a closing position. Thus, the four side walls can be folded into place prior to the insertion of the contents into the container. After the contents have been inserted, then the top wall can be folded in place to lock and secure the box.

Another important feature of the present invention is the fact that the flaps of the lid are concealed when the box is closed, thus avoiding potential complications that could arise if any or all were either inside the cavity of the container, or exposed outside the box. The interior and exterior of the box are smooth. On the inside there are no protrusions from flaps on any of the vertical walls which can catch upon the contents of the container. On the outside, there are no vulnerable protrusions from any portion of the lid overlapping the sides or front. When the box is closed by folding the lid downwardly, the contents of the box are not touched by the flaps of the lid. This eliminates the possibility of disturbing the contents of the container or of having difficulty in closing the container due to one or more flaps striking the contents of the box.

When the box is closed, the front, rear and side walls include three layers of panels, i.e., the inner panel, the outer panel, and the flaps which are inserted between the inner and outer panels. This makes the box extremely strong and secure. Furthermore, the box will not readily pop open and the contents are not accessible as they would be if there were no side flaps on the lid.

DETAILED DESCRIPTION OF THE PREFERRED EMBODIMENT

Figure 4:
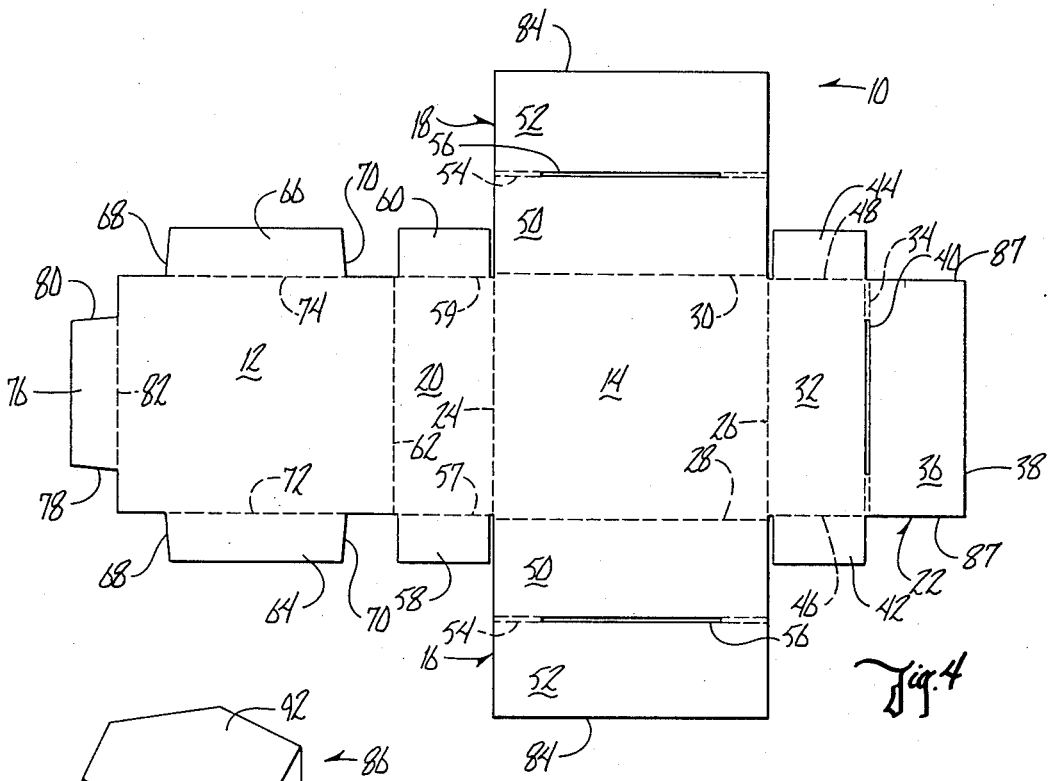
FIG. 4 is a plan view of a pattern which will form the present invention.

Referring to the drawings, the numeral 10 generally refers to the shipping container of the present invention. Container 10 includes a top wall 12, a bottom wall 14, two opposite side walls 16, 18, a rear wall 20 and a front wall 22. Bottom wall 14 includes a rear folding edge 24 (FIG. 4), a forward folding edge 26, and two opposite side folding edges 28, 30.

Front wall 22 includes an outer panel 32 attached to folding edge 26 of bottom wall 14. Outer panel 32 includes an upper edge which coincides with a fold line 34. Inner panel 36 is attached to outer panel 32 and is folded along fold line 34. Inner panel 36 includes a lower edge 38 which when folded downwardly is positioned adjacent bottom wall 14. An elongated slot 40 is provided along fold line 34 and provides communication between the inner and outer panels 32, 36 when the panels are folded into position. Inner panel 32 also includes a pair of end flaps 42, 44 which are adapted to fold along fold lines 46, 48.

Side walls 16 and 18 are identical in construction and include an outer panel 50 and an inner panel 52 which are joined along fold line 54. Positioned along fold line 54 is an elongated slot 56 which provides communication to the space between outer and inner panels 50, 52 when panels 50, 52 are folded over one another.

Rear wall 20 is connected to bottom wall 14 and is adapted to fold along fold line 24. Rear wall 20 includes end flaps 58, 60 which fold along fold lines 57, 59, respectively. The upper edge of rear wall 20 is provided with a fold line 62 to which is attached top wall 12. Top wall 12 includes two side flaps 64, 66 which include tapered ends 68, 70, and which are connected to top wall 12 along fold lines 72, 74. A front flap 76 includes tapered ends 78, 80 and is connected to top wall 12 along fold line 82.

Figure 1:
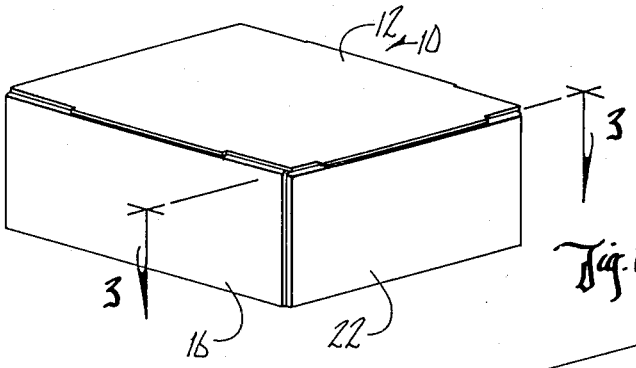
FIG. 1 is a perspective view of a preferred embodiment of the present invention.
Figure 2:
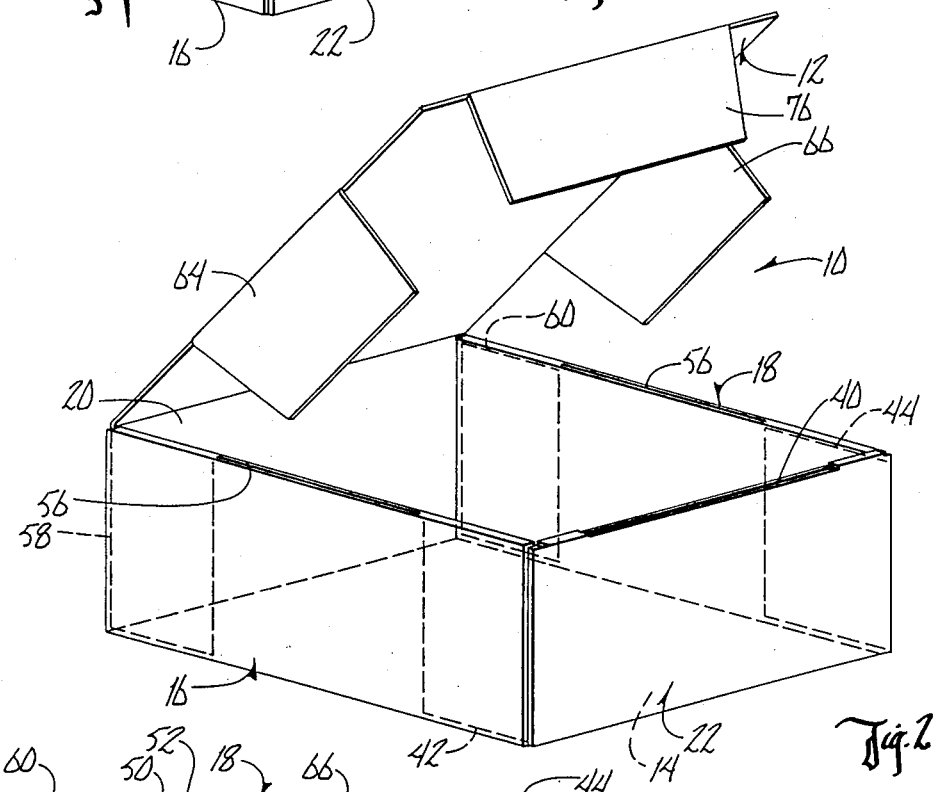
FIG. 2 is a perspective view showing the container partially unfolded.

The device is folded into a container in the following manner. Front wall 32 and rear wall 20 are folded along fold lines 26, 24, respectively, to a position perpendicular to bottom wall 14. End flaps 58, 60 of rear wall 20 and end flaps 42, 44 of front wall 32 are then folded perpendicular to rear wall 20 and front wall 32, respectively, so that they lie in a plane which is approximately parallel to the fold lines 28, 30 of bottom wall 14. Next, side walls 50 are folded into a vertical position with respect to bottom wall 14 and inner panels 52 are folded along fold lines 54 so that their lowermost edges 84 are folded over flaps 58, 60, 42 and 44 and are positioned adjacent bottom wall 14. After the side walls have been folded over flaps 42, 44, 58, 60, the inner panel 36 of front wall 32 is folded downwardly along fold line 34 so that its lower edge 38 is adjacent bottom wall 14. The end edges 87 of inner panel 36 abut against the inner panels 52 of side walls 16, 18 so as to prevent the inner panels 52 of side walls 18 from moving inwardly with respect to the container. The rectangular configurations of flaps 58, 60, 42 and 44 hold the rear wall 20 and the front wall 22 in securement to the side walls 16, 18 as shown in FIG. 2. In this position, slots 40 and 56 are presented upwardly along the uppermost edges of front wall 22 and side walls 16, 18. The contents of the container are placed within the interior, and top wall 12 is folded along fold line 62 in covering relation over the top of the container. Flaps 64, 66 and 76 are folded along fold lines 72, 74, 82, respectively. Flaps 64, 66 are fitted within slots 56 and flap 76 is fitted within slot 40. The flaps protrude between the inner and outer panels 50, 52 of side walls 16 and 18 and between the inner and outer panels 32, 36 of front wall 22.

Figure 3:
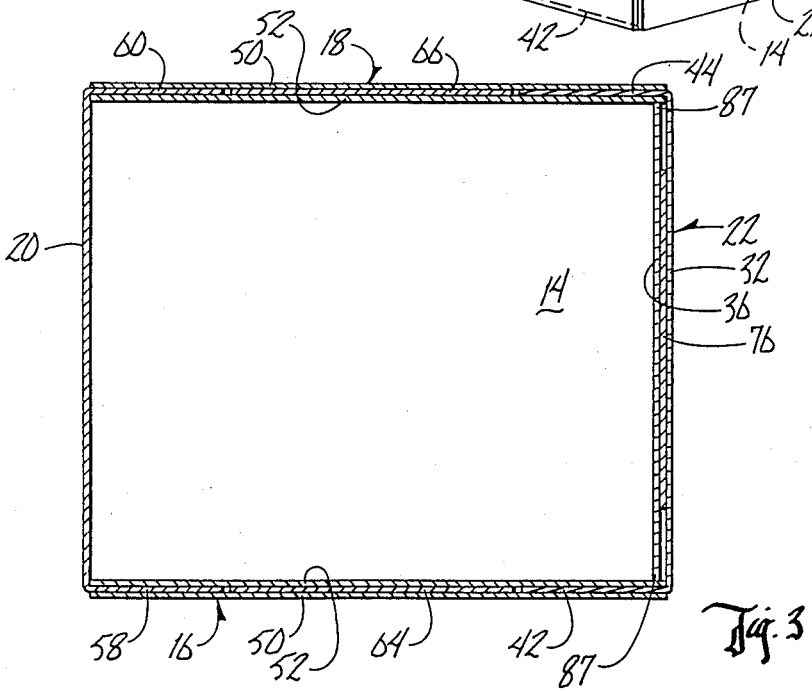
FIG. 3 is a sectional view taken along line 3—3 of FIG. 1.

As can be seen in FIG. 3, when the box is fully folded, the side walls 16, 18 and the front wall 22 are of three ply construction, with the inner and outer panels of each wall providing two of the plys and with the flaps 64, 66 and 76 and the flaps 58, 60 and 42, 44 providing the middle ply.

Figure 5:
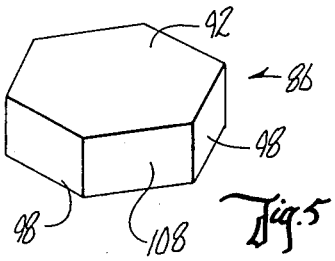
FIG. 5 is a perspective view of a modified form of the present invention.
Figure 6:
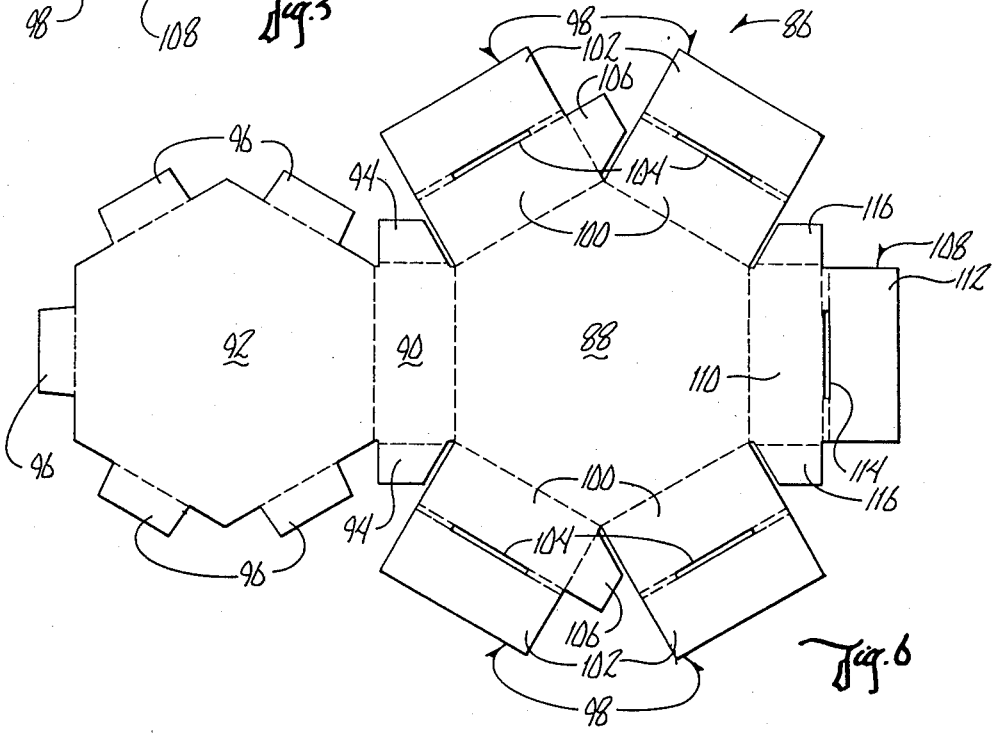
FIG. 6 is a plan view of a pattern of the modified form of the present invention shown in FIG. 5.

FIG. 5 shows a modified form of the invention which is designated by the numeral 86. Device 86 folds in the same manner as device 10, with the exception that a plurality of side walls are included between the front wall and the rear wall so as to create a hexagonal shape. Other polygons may be formed using the same principle of the present invention. Device 86 includes a bottom wall 88, having a rear wall 90, and a hexagonally shaped top wall 92 attached thereto. Rear wall 90 includes end flaps 94 and top wall 92 includes a plurality of flaps 96 thereon.

A plurality of side walls 98 are connected to bottom wall 88 and each include an outer panel 100 and an inner panel 102 which have an elongated slot 104 therebetween. Two of the outer panels 100 include a trapezoidal flap 106. A front wall 108 includes an outer panel 110 and an inner panel 112 with a slot 114 therebetween. The ends of outer panel 110 are each provided with a trapezoidal flap 160.

The device 86 is folded in a manner similar to that shown for device 10 in FIG. 2. The side walls are folded into position, with the triangular flaps 106 extending between the folded over inner panels 100, 102 of the adjacent side walls. Similarly, flaps 94 and 116 are also folded between the inner and outer panels 100, 102 of the side walls 98. Finally, the top wall 92 is folded into place with flaps 96 protruding within the various slots 104 and 114 of the side walls 98 and front wall 108.

The front panel of the present invention is important because it folds over itself, forming a double layer. The inside layer serves the purpose of securing the inner panels of the side walls, thus creating a solid container which holds its shape and keeps all panels vertical and inert. None of the folded-over panels can spring in toward the center of the container. Also, the box does not need fasteners or slits in the base to hold protrusions from the fold-over panels in order to keep the two side panel fold-overs in place. The present invention permits all the front and rear and side walls to be secured before moving the lid into the closing position.

Another important feature of the present invention is the fact that the flaps of the lid are concealed when the box is closed. This avoids potential complications that could arise if any or all of the flaps were inside the cavity of the container or exposed to the outside of the box. The interior and exterior are completely smooth. On the outside, there are no protrusions from flaps on any of the vertical walls for any of the contents to catch upon. On the outside, there are also no vulnerable protrusions from any portion of the lid overlapping the sides or front.

In closing the box, the contents are not touched by the flaps of the lid. This eliminates the possibility of disturbing the contents or of having difficulty in closing the container due to one or more flaps striking the contents as the box is closed.

When the box is closed, the front flap of the lid inserted between the two walls of the front panel provides the equivalent of a three ply front panel which is very strong and secure. Also, the box does not pop open easily, and once it is closed the contents are not accessible as they would be if there were no side flaps on the lid.

In view of the foregoing, it is believed that the present invention accomplishes at least all of its stated objectives.

What is claimed is:

1. A rectangular folding shipping container comprising:

a rectangular bottom wall having a front edge, a rear edge, and opposite side edges;

a rectangular rear wall having a bottom edge connected to said rear edge of said bottom wall along a fold line, said rear wall having an upper edge, and two opposite end edges, a pair of rear wall flaps each connected to one of said end edges of said rear wall along a fold line;

a rectangular top wall having a rear edge, a front edge, and two opposite side edges, said rear edge of said top wall being connected to said upper edge of said rear wall along a fold line;

a front top flap, and a pair of side top flaps each being connected to one of said front and side edges respectively of said top wall;

a pair of rectangular sdiewalls each having front and rear ends and extending upwardly from one of said side edges of said bottom wall, each of said sidewalls comprising an outer sidewall panel and an inner sidewall panel, each having an upper edge, a lower edge, and opposite end edges, said upper edges of said inner and outer sidewall panels being joined along a fold line, said lower edge of said outer sidewall panel being joined to one of said side edges of said bottom wall, said lower edge of said inner sidewall panel being closely adjacent said bottom wall;

a rectangular front wall extending upwardly from said front edge of said bottom wall and comprising an outer front wall panel and an inner front wall panel, each of which has an upper edge, a lower edge, and two opposite end edges, said upper edges of said inner and outer front wall panels being joined along a fold line, said lower edge of said outer front wall panel being joined to said front edge of said bottom wall, said lower edge of said inner front wall panel being closely adjacent said bottom wall;

a pair of front wall flaps, each of which is joined along one of said end edges of said outer front wall panel;

said rear wall flaps each protruding between said inner and outer sidewall panels adjacent said rear end of one of said sidewalls;

said front wall flaps each protruding between said inner and outer sidewall panels adjacent said front end of one of said sidewalls;

said rear wall flaps and said front wall flaps being spaced from one another between said inner and outer sidewall panels to define a slot cavity therebetween;

each of said fold lines between said inner and outer sidewall panels and between said inner and outer front wall panels being provided with a longitudinal slot therein;

said side top flaps of said top wall each protruding through one of said slots of said sidewalls, extending downwardly to said bottom wall and substantially completely filling said slot cavities therein so as to combine with said inner and outer sidewall panels and with said rear wall flaps and said front wall flaps to create a three ply construction to each of said sidewalls;

said front top flap protruding through said slot of said front wall and extending downwardly between said inner and outer front wall panels to said bottom wall so as to combine with said inner and outer front wall panels to create a three ply construction to said front wall.

2. A shipping container according to claim 1 wherein each of said front wall flaps and each of said rear wall flaps includes an upper edge which is shaped to engage said inner and outer sidewall panels adjacent said fold line between said inner and outer sidewall panels so as to lock said front wall and said rear wall in a position perpendicular to said bottom wall.

3. A shipping container according to claim 2 wherein said opposite end edges of said inner front wall panel engage said inner sidewall panels of said opposite sidewalls to hold said lower edges of inner sidewall panels against movement away from said rear wall flaps, said front wall flaps and said side top flaps which are positioned between said inner and outer sidewall panels.

* * * * *